US007008218B2

(12) United States Patent
Zhang et al.

(10) Patent No.: US 7,008,218 B2
(45) Date of Patent: Mar. 7, 2006

(54) COMBUSTION EMISSION ESTIMATION WITH FLAME SENSING SYSTEM

(75) Inventors: Hui Zhang, West Hartford, CT (US); Paul H. Chase, East Granby, CT (US); James M. Niziolek, Enfield, CT (US)

(73) Assignee: ABB Inc., Norwalk, CT (US)

( * ) Notice: Subject to any disclaimer, the term of this patent is extended or adjusted under 35 U.S.C. 154(b) by 0 days.

(21) Appl. No.: 10/222,623

(22) Filed: Aug. 19, 2002

(65) Prior Publication Data

US 2004/0033457 A1 Feb. 19, 2004

(51) Int. Cl.
*F23N 5/08* (2006.01)

(52) U.S. Cl. ..... 431/79; 431/12; 431/281; 340/577

(58) Field of Classification Search ..... 431/79, 431/78, 77, 12, 9, 278, 281, 24; 340/578, 340/579, 577; 250/554, 339.15
See application file for complete search history.

(56) References Cited

U.S. PATENT DOCUMENTS 4,410,266 A * 10/1983 Seider ..... 431/79
4,653,998 A * 3/1987 Sohma et al. ..... 431/79
4,913,647 A * 4/1990 Bonne et al. ..... 431/12
5,222,887 A * 6/1993 Zabielski, Sr. ..... 431/12
5,798,946 A * 8/1998 Khesin ..... 340/578
5,971,747 A * 10/1999 Lemelson et al. ..... 431/12
6,356,199 B1 * 3/2002 Niziolek et al. ..... 340/579
6,389,330 B1 * 5/2002 Khesin ..... 431/79

FOREIGN PATENT DOCUMENTS

EP 0 766 080 A1 * 4/1997
WO WO 97/24560 A1 * 7/1997

* cited by examiner

*Primary Examiner*—Josiah C. Cocks
(74) *Attorney, Agent, or Firm*—Michael M. Rickin, Esq.; Paul R. Katterle

(57) ABSTRACT

There is described a method and apparatus for controlling the combustion by-product formation rate in at least one burner of a fossil fuel fired power plant. The burner has an associated flame scanner which is focused on a small area of the burner flame to obtain an image signal of the flame. A flame signal that represents properties of temporal combustion in the visible light spectrum of the burner is generated from the image signal. Combustion turbulence at the burner is analyzed from the flame signal by a dynamic invariant that has a relationship to the combustion by-product values and different combustion by-product levels at the burner and the combustion turbulence is correlated to the combustion by-product formation rate at the burner. The method and apparatus can also be used to correlated the combustion turbulence at a multiplicity of burners to the associated combustion by-product formation rate.

13 Claims, 8 Drawing Sheets

COMBUSTION EMISSION ESTIMATION WITH FLAME SENSING SYSTEM

FIELD OF THE INVENTION

This invention relates to methods and apparatus for in-situ observation and estimation of combustion emission while combustion takes place in a fossil fuel fired power plant.

DESCRIPTION OF THE PRIOR ART

Among different fossil fuels, coal is the nation's most plentiful and readily available domestic fossil fuel source. It accounts for about 55 percent of the power generated in the United States. Greater utilization of this abundant domestic energy resource will be largely contingent upon the development of technologies that mitigate environmental hazards from the combustion of coal. Such technologies include clean coal technologies, gasification, indirect liquefaction, and hybrid power plants partnering coal with renewable energy source.

By government estimates, the country will need at least 1,300 new electric-power plants over the next 20 years. Coal, which already generates more than half of U.S. capacity, is a logical choice to power many of them. The administration of President George W. Bush is pushing toward having "a clean-air policy and burn coal at the same time".

The burning of coal produces combustion byproducts. The primary constituent of these combustion byproducts is nitrous oxides (NOx) which are formed when the minimal amount of nitrogen in the air combines with oxygen. Since these combustion byproducts pollute the air it is desirable to control power plant emissions. The state-of-the-art approach to emission control is to use the information from a flue gas analyzer to trim the combustion control system. This technique achieves only global emission control since the behavior of each burner is not observed, even though the burners might be different from one another.

In a typical industrial/utility boiler configuration, the number of burners could be in the range of 10 to 50. It is widely known that the fuel/air imbalance among different burners exists to a great extent and thus global emission control is neither efficient nor economical.

Accordingly, it is an object of the present invention to provide methods and apparatus for localized burner flame emission observation and estimation to thereby control combustion byproducts. It is another object of the invention to avoid using expensive laboratory grade equipment (e.g., a spectrometer to cover a wide range of wavelength) for sensing the flame emission.

We have discovered that when a flame scanner with a narrow viewing angle is used to observe the visible light range of a burner flame the resultant flame scanner flame image signal consists of identifiable and statistically consistent information related to the fuel/air ratio in the combustion process. We have found that this combustion turbulence information for a burner correlates to the combustion byproduct emission level for that burner. The flame scanner may be a digital flame scanner (DFS) or any other type of flame scanner that produces the desired flame image signal.

By employing statistical wavelet analysis on the flame signal, this relationship to combustion byproduct emission level, for example, NOx level, is established systematically and provides a reliable and noninvasive method for feedback control of boiler emission level for individual burner. With a flame scanner, such as for example a DFS, observing the flame from each burner, the emission information can be extracted from the DFS signal and then timely and detailed information for combustion of each burner can be supplied to the boiler control system for efficient emission control.

SUMMARY OF THE INVENTION

In a fossil fuel fired power plant having a combustion area with at least one burner and an associated flame scanner, a method for controlling combustion by-product formation rate. The method is:

a) obtaining an Image signal of flame in the at least one burner by focusing the flame scanner on an area of the flame in the at least one burner where the flame flicker frequency is characteristic of a limited number of combustion pockets in which fuel and air mix and burn;

b) generating from the image signal a flame signal representing properties of temporal combustion in the visible light spectrum at the at least one burner; and c) relating a combustion by-product emission level from the at least one burner to the flame signal by calculating a dynamic invariant of the flame signal that provides measure of the nonlinear dynamics of the flame, the dynamic invariant being nearly constant at the same combustion by-product emission level of the at least one burner and having a consistent relationship with different emission levels of the combustion by-product.

In a fossil fuel fired power plant having a combustion area with at least one burner and an associated flame scanner, a method for controlling combustion by-product formation rate of the at least one burner. The method is:

a) generating a flame signal representing properties of temporal combustion In the visible light spectrum at the at least one burner from an image signal of flame in the at least one burner, the image signal obtained by focusing the flame scanner on an area of the flame in the at least one burner where the flame flicker frequency is characteristic of a limited number of combustion pockets in which fuel and air mix and burn; and b) relating a combustion by-product emission level from the at least one burner to the flame signal by calculating a dynamic invariant of the flame signal that provides measure of the nonlinear dynamics of the flame, the dynamic invariant being nearly constant at the same combustion by-product emission level of the at least one burner and having a consistent relationship with different emission levels of the combustion by-product.

DESCRIPTION OF THE PREFERRED EMBODIMENT(s)

The present invention is described below in connection with the control of a a particular combustion byproduct formation rate, namely, NOx formation rate, and the embodiment described herein uses a DFS to sense the flame at a burner. As will be appreciated by those of ordinary skill in the art after reading this description of the preferred embodiment, the present invention can be used to control the formation rate of any combustion byproduct and can use any flame scanner that meets the criteria described herein.

NOx is formed from several sources and can, depending on the source, be classified as fuel NOx, thermal NOx and prompt NOx. Fuel NOx comes from the oxidation of organically bound nitrogen in fuel and is affected by the mixing of fuel and air and by the local $O_2$ cone as well. Thermal NOx results from the thermal fixation of molecular $N_2$ and $O_2$ in the combustion air at a temperature higher than 2000° F. The formation of thermal NOx is extremely sensitive to the local temperature. Prompt NOx is produced in small amounts by the reaction of nitrogen radicals and hydrocarbon in the fuel.

While there are many important factors affecting the NOx emissions, only several of those factors can be directly or indirectly identified from the flame signal. Temperature information can be obtained from the infrared part of the flame signal. The fuel-to-air ratio information can be extracted from the low-frequency components of the flame signal.

Correlation of flame fluctuation (or flicker) with flame quality and emissions can be understood as follows. In individual burner flames, the combustion process is dominated by the rate of mixing of fuel and air, while the chemical kinetics is much faster. Each burner flame consists of a multitude of combustion recirculation cycles (eddies) of various sizes inside and around the flame. These eddies contribute to generating the flame flicker at various frequencies as a result of turbulent mixing at the edges of the fuel and air jets. Smaller eddies occur more frequently and generate higher frequencies, and vice versa. The movement of eddies in turbulent flows affects the mixing rate of air and fuel in turbulent diffusion flames.

The amount of fuel and air mixed is controlled by the size of the eddy. Since combustion kinetics are fast compared to these turbulent mixing times, the fuel and air are combusted essentially instantly. Because a large eddy may entrain more fuel than a smaller eddy, a larger eddy should give larger emission intensity. Each flame characteristic, for example fuel to air ratio, swirl, mixing rate or combustion efficiency, is associated with a dominant radiation segment in the temporal frequency spectrum. The relative intensity of this dominant segment contributes to the shape of the frequency spectrum.

Figure 1:
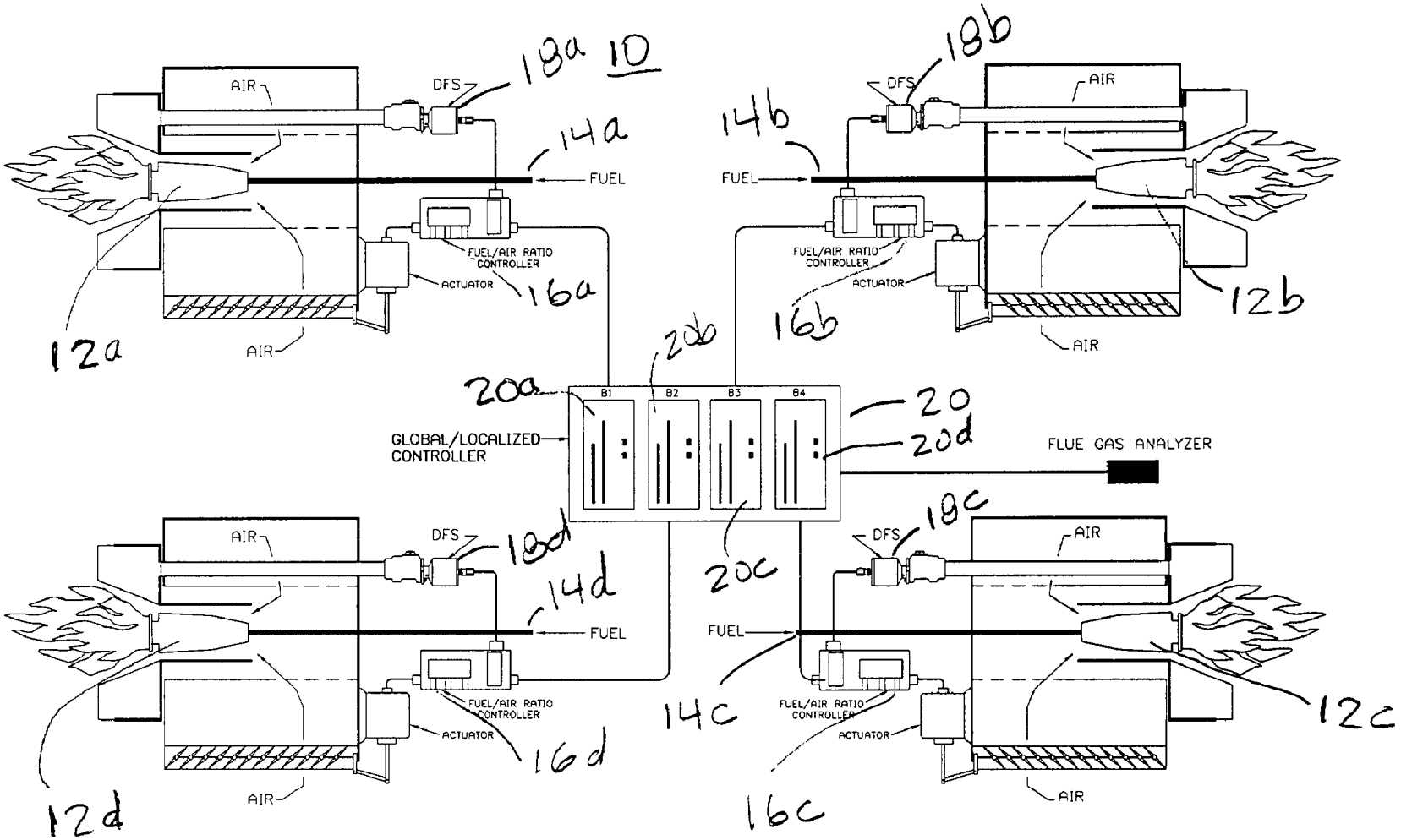
FIG. 1 shows a functional diagram of the system that in accordance with the present invention uses a DFS to observe the flame signal.

Referring now to FIG. 1, there is shown a functional diagram of the system 10 that in accordance with the present invention uses a DFS to observe the flame signal. In the embodiment shown in FIG. 1, the fossil fuel fired power plant has four burners 12*a*, 12*b*, 12*c* and 12*d* each having an associated fuel inlet 14*a*, 14*b*, 14*c* and 14*d*, associated fuel/air ratio controller actuator 16*a*, 16*b*, 16*c* and 16*d* and associated DFS 18*a*, 18*b*, 18*c* and 18*d* connected to associated fuel/air ratio controller actuator 16*a*–16*d*. System 10 also has a single hybrid global/localized controller 20 having a portion thereof 20*a*–20*d* connected to each fuel/air ratio controller 16*a*–16*d*.

It would be unrealistic to precisely determine the NOx emission level just from the temperature and fuel-to-air ratio information, considering the complexities of the combustion process and NOx formation described above. We have, using advanced signal processing techniques (e.g., wavelet analysis) coupled with the intelligent decision methods described below, identified from experimental data the hidden connections between NOx level and flame signal.

Figure 2:
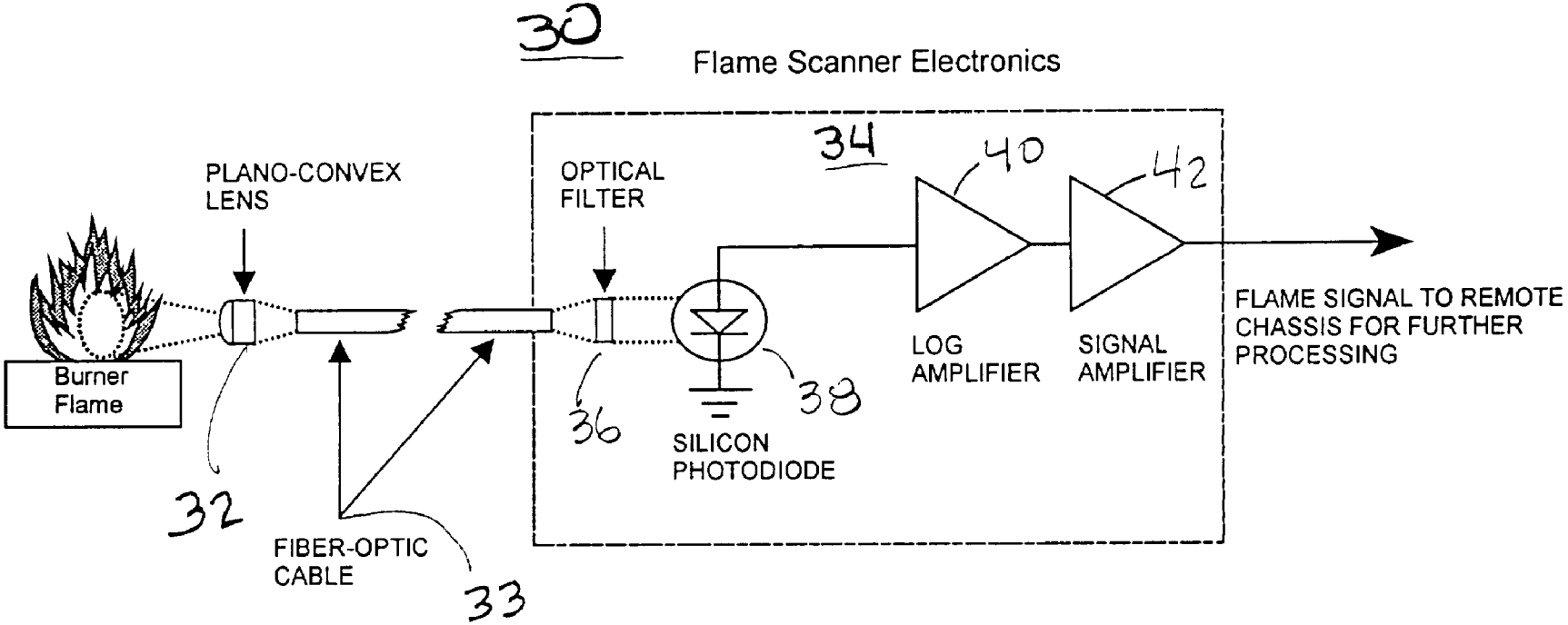
FIG. 2 shows one embodiment for the flame sensing system used in the system of FIG. 1.

The flame is observed by the flame sensing system 30 shown in FIG. 2. System 30 consists of a lens system 32, flame scanner electronics 34 comprising wavelength filter system 36, sensor 38 in the form of a silicon carbide photodiode and signal conditioning electronics in the form of a log amplifier 40 and a signal amplifier 42.

One of the fundamental elements in generating a flame signal that will correlate with NOx is to limit the area of the burner flame under analysis. The predominate contributor to flame flicker is the mixing rate of fuel and air. A major constituent of a burner flame consists of fuel and air combusting as individual pockets of flame. The pockets, or eddies, are irregular in shape and occur in various sizes. This continuous stream of combusting eddies, give off pulsations that are related to the fuel-to-air ratio, mixing rate, combustion efficiency and ultimately, stack emissions. The present invention uses this turbulent combustion characteristic by limiting the viewing area when monitoring the process.

Lens system 32, which is embodied as a plano-convex lens, focuses on a small area of the burner flame where the resulting flicker frequency is characteristic of a limited number of combustion pockets in which fuel and air mix and burn. The lens system 32 in this embodiment is a single lens but could be configured with multiple lenses.

A fiber-optic cable 33 transmits the flame wavelength energy from lens system 32 to optical filter system 36 that blocks wavelengths in excess of 700 nm, that is infrared wavelengths, from reaching the detector or sensor 38. Optical filter system 36 blocks infrared wavelengths from the sensor 38 to prevent the higher energy levels of those wavelengths from swamping the signals occurring from chemical reactions in the visible light zone. As an alternative, the fiber-optic cable 33 could be replaced with a system where just the filtered flame wavelength energy is focused on the silicon photodiode 38 by a single plano-convex lens or a multiple lens arrangement.

Flame wavelength energy passing through the optical filter system 36, impinges on the silicon photodiode 38 and generates an analog signal representing properties of temporal combustion in the visible light spectrum. Substituting other detectors for the silicon photodiode 38, such as a photoconductive or photovoltaic cell, may generate this same analog signal as long as the detectors have sufficient sensitivity throughout the range of 400–700 nm wavelengths. The analog signal generated by the detector spans 4 or 5 decades of amplitude and requires amplification over the entire range without loss of signal to saturation.

The flame scanner electronics 34 shown in FIG. 2 utilizes a log amplifier 40 to accomplish this compression. The output of log amplifier 40 is further conditioned by signal amplifier 42 for transmission to a remote processor (not shown in FIG. 2) for analysis. In this embodiment the log amplifier output is transformed into a current signal for fidelity of transmission over long distances.

Figure 3:
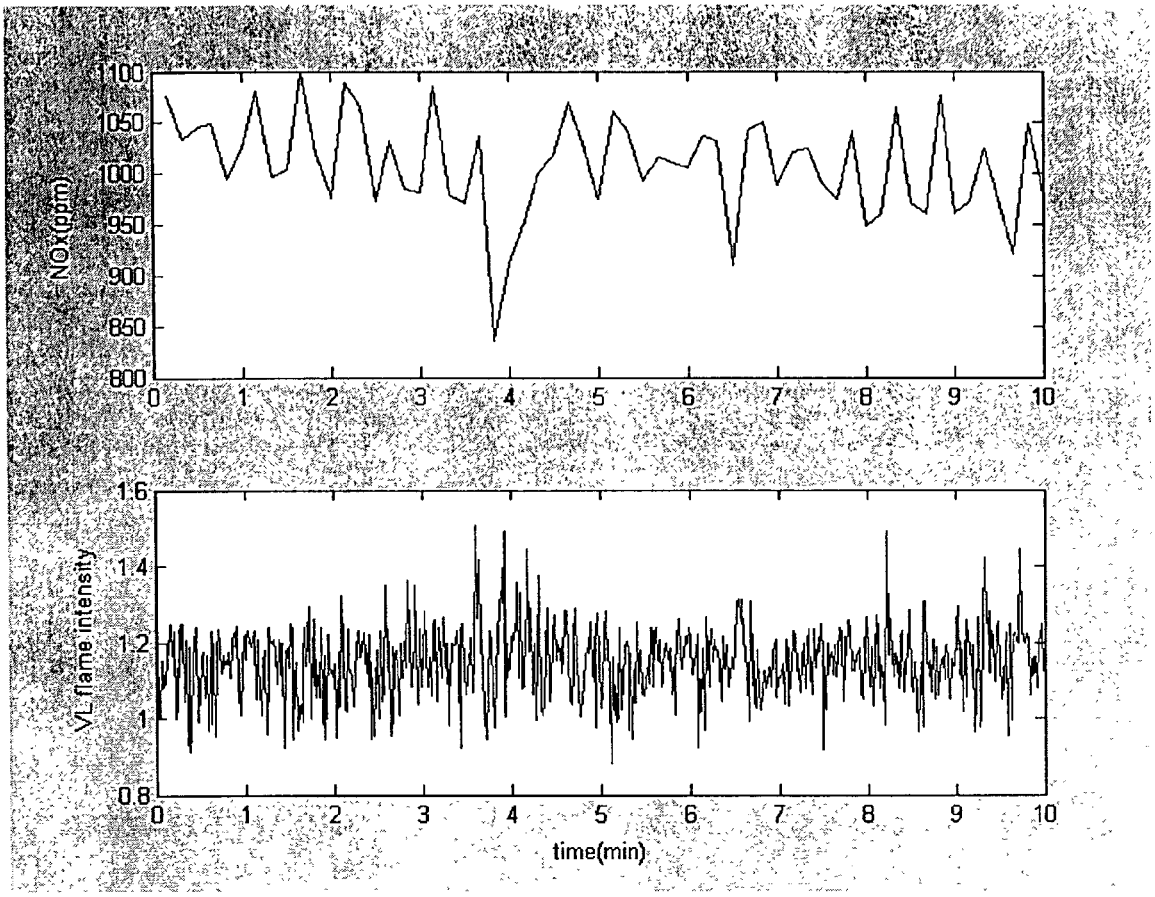
FIGS. 3 and 4 each show for the single burner experimental furnace the typical DFS flame signal plotted against two different levels of NOx.
Figure 4:
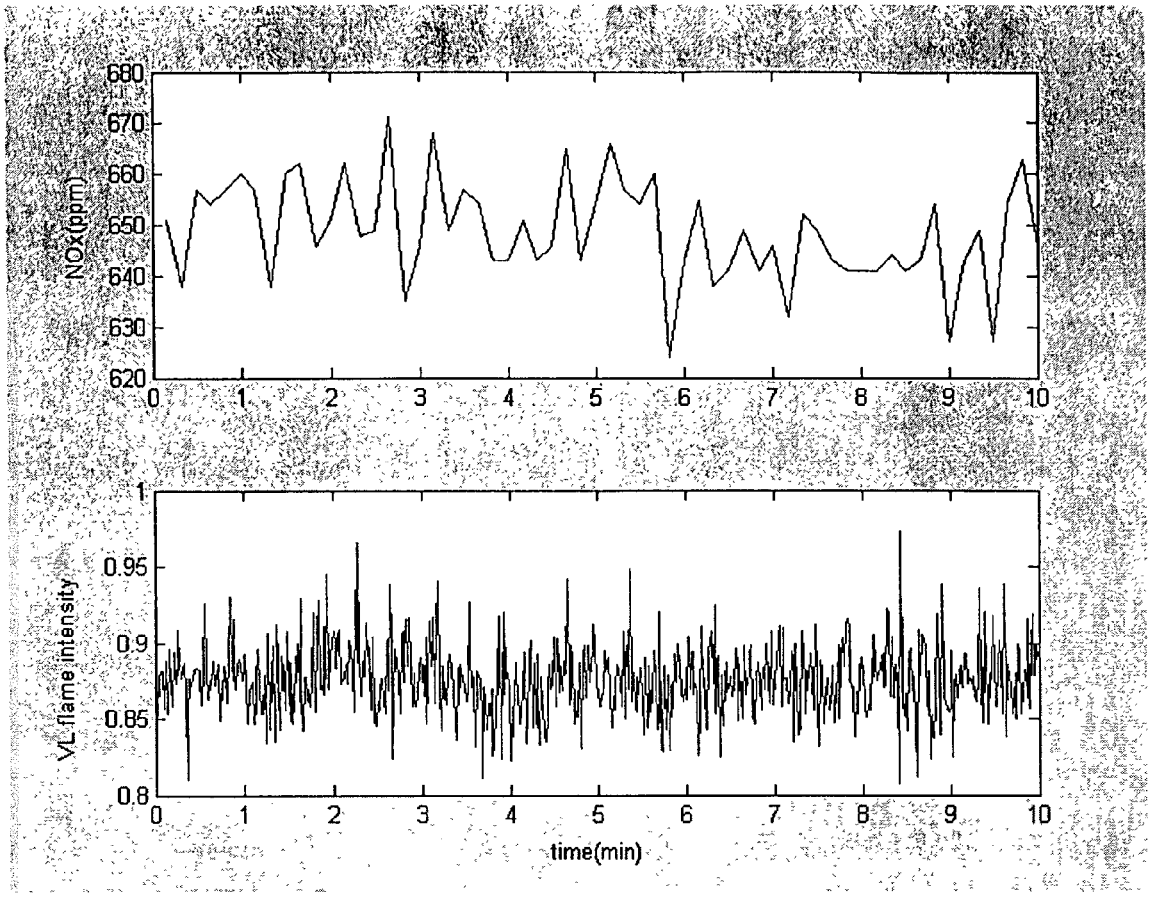

The experiment to collect the experimental data that we have used to establish the connection between NOx level and flame signal is conducted under constant coal feed rate and constant airflow rate on a single-burner experimental furnace (not shown). The NOx level is adjusted by burner position. FIGS. 3 and 4 show the typical NOx measurement at different concentrations and the plot of the associated flame signal observed with the flame scanner.

The complex combustion process involves slow fluid turbulence and fast chemical reactions. Flame signals, as a manifest of this complex process, exhibit seemingly random features. This randomness is actually not "stochastic", but "deterministic". In fact flame signals demonstrate the so-called "deterministic chaos", a type of nonlinear dynamics whose future behavior is greatly influenced by small variations of the initial conditions.

The correlation of the flame signal with NOx emission level requires defining a dynamic invariant to measure the nonlinear chaotic flame dynamics, that is the turbulent combustion, independent of initial conditions. The dynamic invariant, also called measure in mathematics, has to be nearly constant in the same NOx level and shows consistent relationship with different NOx values.

Four measures have been identified and appear to be effective. They are:

Mean standard deviation the ratio of low-frequency components in the power spectrum the ratio of approximation components in the wavelet decomposition.

For a given signal x(k), k=1 . . . N, the mean is defined as $$u = \frac{1}{N}\sum_{k=1}^{N} x(k) \tag{1}$$

For a given signal x(k), k=1 . . . N, the standard deviation is defined as $$\sigma = \sqrt{\frac{1}{N-1}\sum_{k=1}^{N}\left[x(k)-u\right]^2} \tag{2}$$

where $\mu$ is the mean defined in Equation (1).

The reason for choosing standard deviation as a measure is that by observing time domain data of the DFS Visible Light (VL) sensor 38, we have found that when NOx level is higher, the variation of the DFS data is also higher. Note the standard deviation measure is independent of the mean measure, since the mean is subtracted in the calculation of standard deviation.

The knowledge of flame dynamics suggests that the low-frequency components of a flame signal dominantly affect the NOx level. To verify and quantify this relationship, power spectral analysis can be applied to flame signals.

In order to eliminate the influence of the signal amplitude, the flame signal is normalized. The normalization of a flame signal x(k) is defined as:

$$\hat{x}(k) = \frac{x(k)-\mu}{\sigma} \tag{3}$$

where $\mu$ and $\sigma$ are mean and standard deviation respectively, as defined before.

Figure 5:
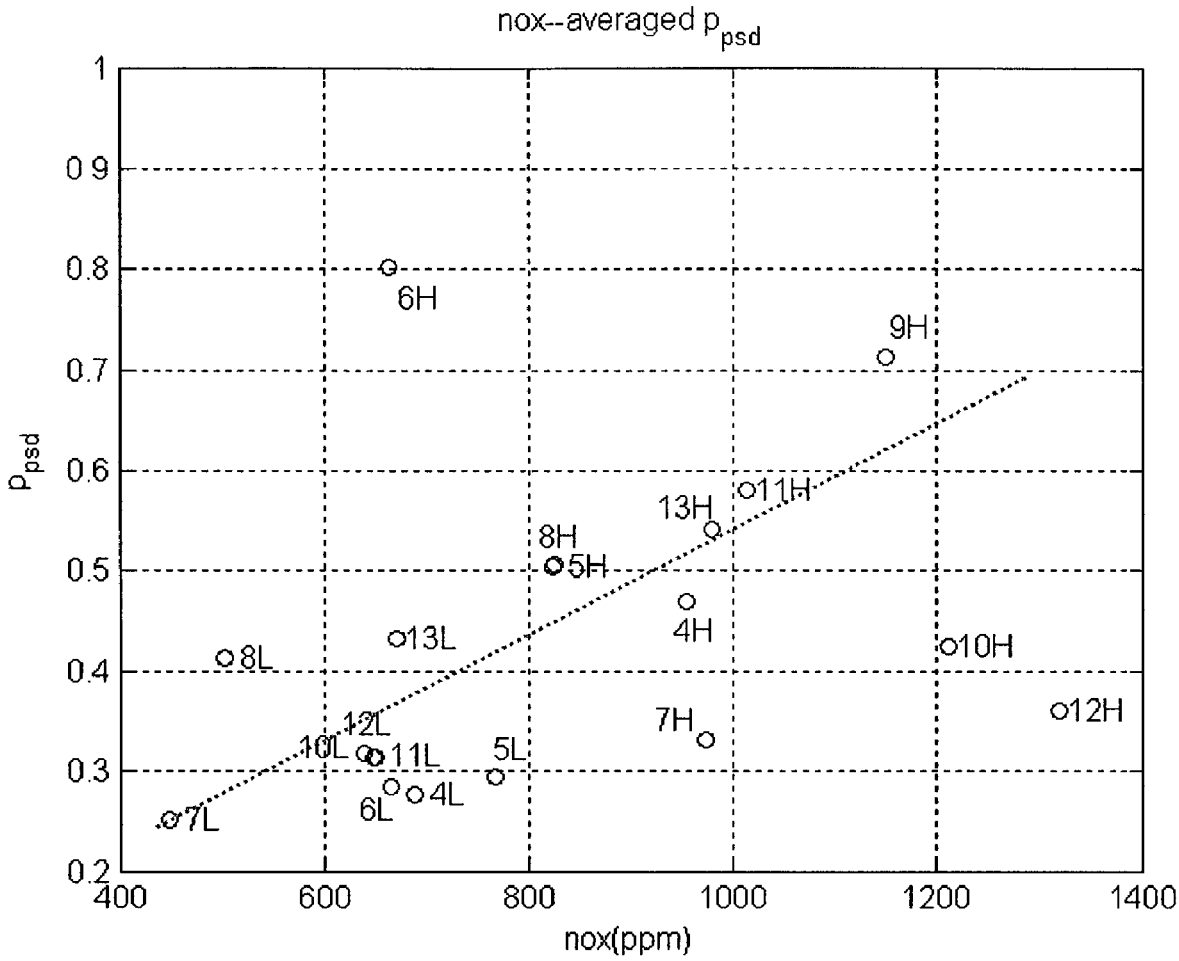
FIG. 5 shows the estimated NOx emission compared against the emission measurement using a power spectrum analysis.

The power spectrum which is shown in FIG. 5 can be seen from the Fourier transformations of the normalized DFS VL sensor data. From the spectrum it can be concluded that as NOx value increases, the low frequency components have relatively higher intensities.

Let the power spectrum of $\hat{x}(k)$ be s(f) (f is frequency), the measure p based on power spectrum density (psd) is defined as $$p_{psd} = \frac{\sum_{i=0}^{i=f_0} s(i)}{\sum_{i=0}^{i=f_b} s(i)} \tag{4}$$

where, $f_0$ defines what are the low frequencies. The selection of an appropriate $f_0$ depends on the characteristic of flame signals. $f_b$ is the bandwidth of flame signal, which can simply taken as half of the sampling frequency.

Wavelet analysis gives another method to process the digital signal in terms of a more natural time-scale perspective. Similar to human beings viewing the world in different scales from star to bacteria, the flame dynamics can be also analyzed in different scales. A large scale corresponds to the slowly changing dynamics, which controls the level of NOx emissions; whereas a small scale is about fast changing dynamics, which is related to the stability of combustion process.

Similar to the classic Fourier analysis, which breaks down a signal into constituent sinusoids of different frequencies, wavelet analysis decomposes a signal into shifted and scaled versions of the mother "wavelet". The so-called "wavelet" is a waveform of effectively limited duration that has an average value of zero.

Let $\psi(u)$ be a mother wavelet, its shifted and scaled version can be written as $$\psi_{s,i} = s^{-\frac{1}{2}}\psi\left(\frac{u-t}{s}\right) \tag{5}$$

where s is called scale level.

The continuous wavelet transform of a signal x(t) is defined as:

$$\tilde{x}(s,t) = \int_{-\infty}^{+\infty}\psi_{s,i}(u)x(u)du = \psi^*_{s,i}x \tag{6}$$

The original signal can be reconstructed from the wavelet coefficients $\tilde{x}(s,t)$ with formula $$x(u) = C\int_{R^2}\int s^{-2}dsdt\psi_{s,i}(u)\tilde{x}(s,t) \tag{7}$$

where C is a constant.

The discrete version of equation (6) gives $$x = \sum_{k\in Z}\sum_{n\in Z}\psi_{k,n}\psi^*_{k,n}x = \sum_{k=M-1}^{\infty}\sum_{n\in Z}\psi_{k,n}\psi^*_{k,n}x + \sum_{k=-\infty}^{M}\sum_{n\in Z}\psi_{k,n}\psi^*_{k,n}x \tag{8}$$

The first term in Equation (8) on the right side is called the "approximation" since it represents the low scale/frequency components, while the second term is called the "details" whose frequency band is higher than the "approximations". The second term can be separated into more terms, with each term having different scales and occupying a different band of high frequencies.

The discrete wavelet analysis therefore decomposes a signal into various components in different scales/frequencies such as $$x(k)=a_4(k)+d_4(k)+d_3(k)+d_2(k)+d_1(k) \tag{9}$$

Figure 6:
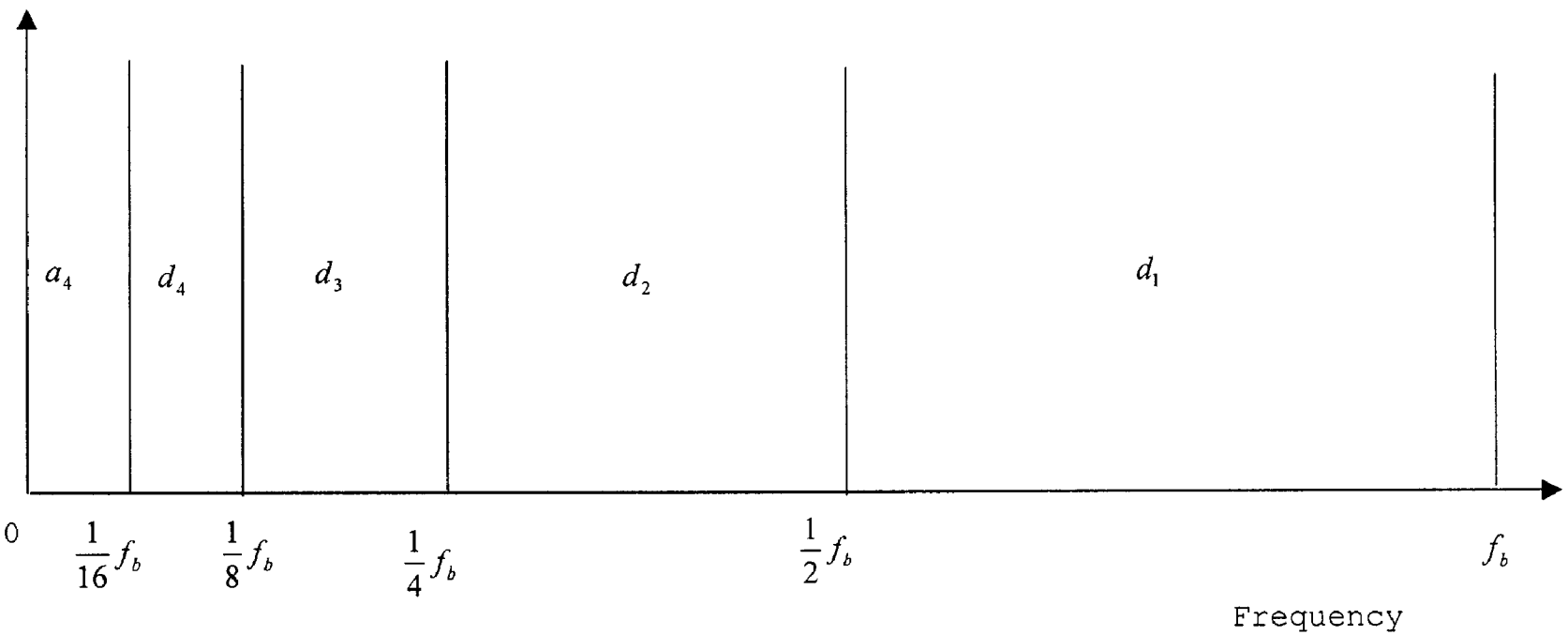
FIG. 6 shows approximately the frequency band distribution of each component in the wavelet analysis.

In the above expression, the subscript indicates the scale level. A larger number means a larger scale, which corresponds to slowly changing components. The "a" component is the approximation, while the "d" components are the details. The frequency band distribution of each component in Equation (9) can be approximately shown in FIG. 6.

For the fast computation or digital circuit implementation, discrete wavelet transformation can be performed by way of filter banks. A low-pass filter generates approximations and a high-pass filter generates details. For multilevel decomposition, the high-pass and low-pass filter pair can be appended to the low-pass filter to decompose the approximation component into another level of approximation and detail.

Since the approximation component in the wavelet decomposition corresponds to the low frequency part, it can be used to define the NOx measure:

$$p_{wa} = \frac{rms(a)}{rms(x)} \tag{10}$$

where rms stands for "root of mean square".

It is also possible to define the measure in terms of detail components:

$$p_{wd} = \frac{rms(d)}{rms(x)} \tag{11}$$

since the details and approximations are complement to each other. In the actual implementation, measure $p_{wa}$ is taken as $$p_{wa} = \frac{rms(a_4)}{rms(x)} \tag{12}$$

while measure $p_{wd}$ is $$p_{wd} = \frac{rms(d_4)}{rms(x)} \tag{13}$$

Figure 7:
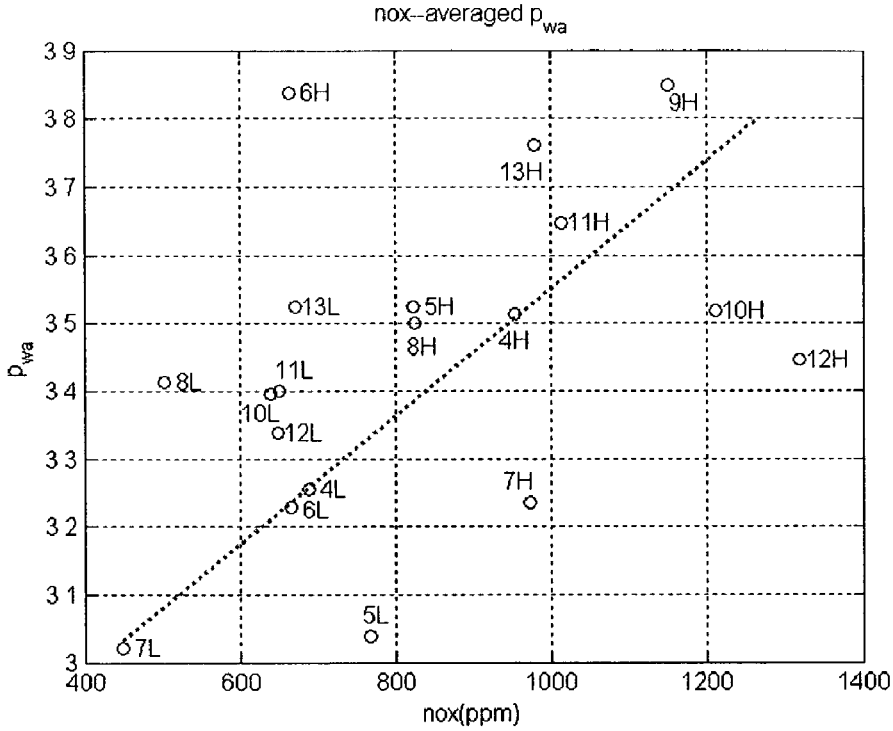
FIGS. 7 and 8 each show the estimated NOx emission compared against emission measurement.
Figure 8:
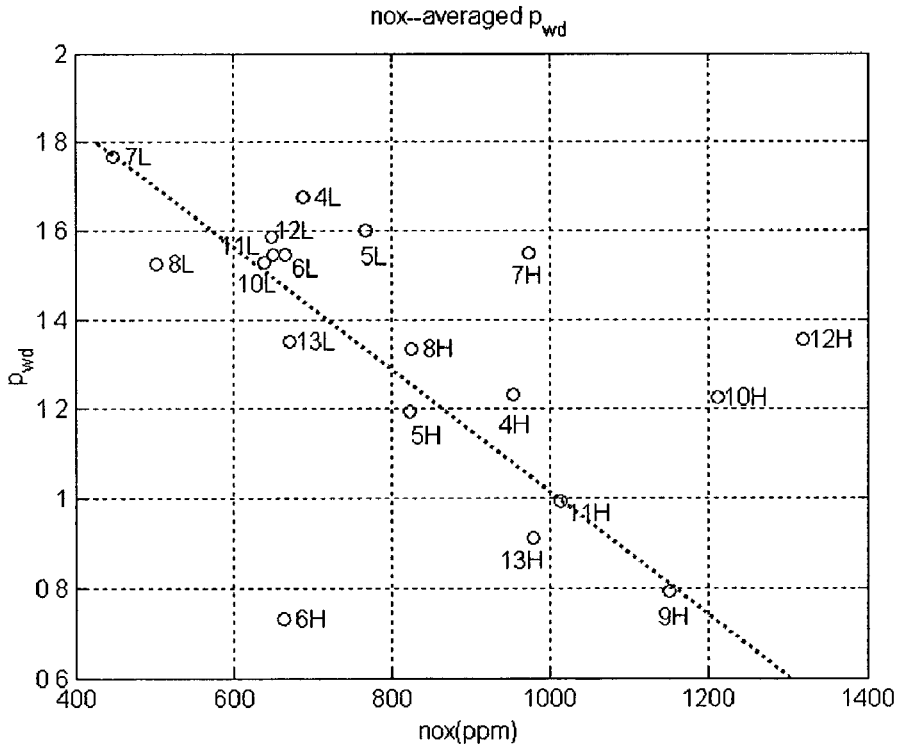

Note that before doing wavelet decomposition, the flame signal needs to be normalized. From FIGS. 7 and 8, it can be seen that as NOx level increases, measure $p_{wa}$ tends to increase while measure $p_{wd}$ tends to decrease. Compared to power spectrum measure $p_{psd}$, it appears that $p_{wd}$ has better consistency.

In summary, five different measures, namely, mean, standard deviation, power spectrum ($p_{psd}$), $p_{wa}$, and $p_{wd}$ (defined as equation 10 and 11) are defined to relate the flame dynamics to NOx emission level. Three of these five measures, namely, power spectrum, $p_{wa}$, and $p_{wd}$, are used to calculate the relative intensity of low frequency components either directly or indirectly in the frequency domain or time-scale domain. For convenience, these three measures are referred to herein as frequency measure.

It should be noted that mean, standard deviation and frequency measure are mutually exclusive, in the sense that they represent mutually exclusive information of the flame signal. It should also be noted that standard deviation is calculated after subtraction of mean, and frequency measure is obtained after normalization.

None of mean, standard deviation and frequency measures shows an excellent fitted curve in their individual analysis. In general, it is found that the frequency measure $p_{wd}$ provides the best consistent estimation across a broad NOx range, while mean and standard deviation provide complementary results at lower and higher NOx levels, respectively. Therefore we determined that all five measures should be combined in order to more reliably predict the NOx level from the flame scanner sensor data.

Figure 9:
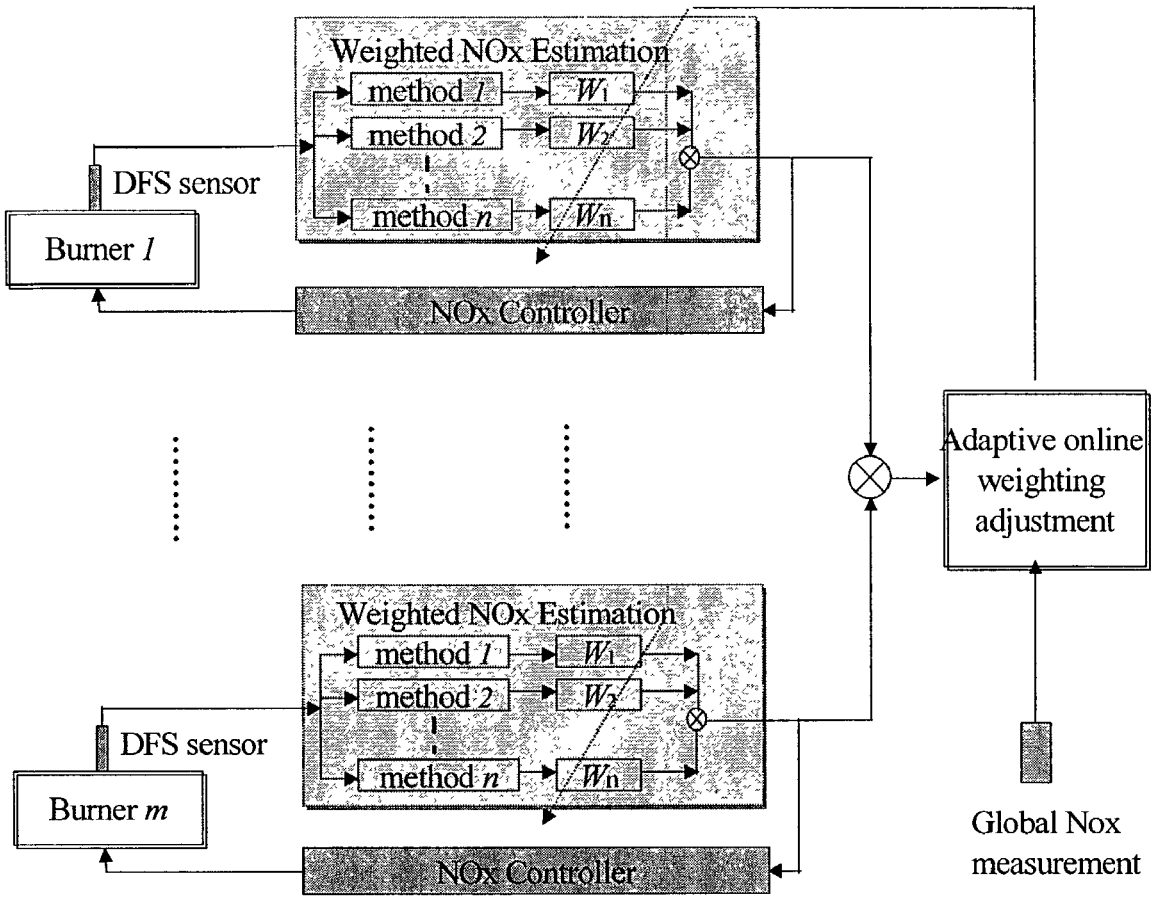
FIG. 9 shows the scheme for intelligent global/localized emission estimation combining pertinent measures.

In a further aspect of the invention, FIG. 9 depicts the combined approach for NOx estimation with on-line adaptive selection/weighting of the different measures described previously. The adaptive approach provides a mechanism for self-adjustment and self-correction to the global NOx measurement. The measure that gives a more close summed result for the specific emission level is given the higher weight and vice versa.

As shown in FIG. 9, each burner has a NOx estimator combining the weighted sum of all pertinent measures, where those weightings are adjusted recursively online by the weighting adjustment scheme using the global NOx online measurement. The advantage of this scheme is that localized NOx estimation is self-calibrated against global measurement recursively, collectively and in real time.

It is to be understood that the description of the preferred embodiment(s) is (are) intended to be only illustrative, rather than exhaustive, of the present invention. Those of ordinary skill will be able to make certain additions, deletions, and/or modifications to the embodiment(s) of the disclosed subject matter without departing from the spirit of the invention or its scope, as defined by the appended claims.

What is claimed is:

1. In a fossil fuel fired power plant having a combustion area with at least one burner and an associated flame scanner, a method for controlling combustion by-product formation rate comprising:

a) obtaining an image signal of flame in said at least one burner by focusing said flame scanner on an area of the flame in said at least one burner where the flame flicker frequency is characteristic of a limited number of combustion pockets in which fuel and air mix and burn;

b) generating from said image signal a flame signal representing properties of temporal combustion in the visible light spectrum at said at least one burner; and c) relating a combustion by-product emission level from said at least one burner to said flame signal by calculating a dynamic invariant of said flame signal that provides a measure of the nonlinear dynamics of the flame, said dynamic invariant being nearly constant at the same combustion by-product emission level of said at least one burner and having a consistent relationship with different emission levels of said combustion by-product.

2. The method of claim 1 further comprising:

using said calculated dynamic invariant to control said combustion by-product emission level.

3. The method of claim 1 wherein said dynamic invariant is calculated using one or more analysis techniques selected from the group consisting of statistical, temporal and frequency analyses of said flame signal and combinations thereof.

4. The method of claim 3, wherein the dynamic invariant is calculated using a weighted combination of mean, standard deviation and low frequency analyses of said flame signal.

5. The method of claim 1, wherein the combustion by-product emission level comprises the NOx emission level.

6. In a fossil fuel fired power plant having a multiplicity of burners each having an associated flame scanner a method for controlling combustion by-product formation rate comprising:

a) obtaining an image signal of flame in each of said multiplicity of burners by focusing each of said associated flame scanners on an area of the flame in said associated one of said multiplicity of burners where the flame flicker frequency is characteristic of a limited number of combustion pockets in which fuel and air mix and burn:

b) generating for each of said multiplicity of burners from said associated image signal an associated flame signal representing properties of temporal combustion in the visible light spectrum at said associated one of said multiplicity of burners: and c) relating a combustion by-product emission level from each of said multiplicity of burners to said associated flame signal by calculating a dynamic invariant of said associated flame signal that provides a measure of the nonlinear dynamics of the flame, said dynamic invariant being nearly constant at the same combustion by-product emission level of said associated one of said multiplicity of burners and having a consistent relationship with different emission levels of said combustion by-product.

7. The method of claim 6 further comprising:

using said dynamic invariant calculated from said associated flame signal to control said associated combustion by-product emission level.

8. The method of claim 7 further comprising:

using the dynamic invariant value calculated from each of said associated flame signal to control the combustion by-product emission level of all of said multiplicity of burners by balancing the difference of each of said associated combustion by-product emission level among each of said multiplicity of burners.

9. The method of claim 6 further comprising:

self-calibrating and adjusting for each of said multiplicity of burners said associated combustion by-product emission level to a combustion by-product emission level for all of said multiplicity of burners recursively, collectively and in real time.

10. The method of claim 6 wherein said dynamic invariant is calculated using one or more analysis techniques selected from the group consisting of statistical, temporal and frequency analyses of said flame signal and combinations thereof.

11. In a fossil fuel fired power plant having a combustion area with at least one burner and an associated flame scanner, a method for controlling combustion by-product formation rate of said at least one burner, comprising:

a) generating a flame signal representing properties of temporal combustion in the visible light spectrum at said at feast one burner from an image signal of flame in said at least one burner, said image signal obtained by focusing said flame scanner on an area of the flame in said at least one burner where the flame flicker frequency is characteristic of a limited number of combustion pockets in which fuel and air mix and burn; and b) relating a combustion by-product emission level from said at least one burner to said flame signal by calculating a dynamic invariant of said flame signal that provides a measure of the nonlinear dynamics of the flame, said dynamic invariant being nearly constant at the same combustion by-product emission level of said at least one burner and having a consistent relationship with different emission levels of said combustion by-product.

12. The method of claim 11 wherein said dynamic invariant is calculated using one or more analysis techniques selected from the group consisting of statistical, temporal and frequency analyses of said flame signal and combinations thereof.

13. The method of claim 12, wherein the dynamic invariant is calculated using a weighted combination of mean, standard deviation and low frequency analyses of said flame signal.

* * * * *